US005366741A

United States Patent [19]

Van Der Zon

[11] Patent Number: 5,366,741

[45] Date of Patent: Nov. 22, 1994

[54] INFUSION PACKETS

[75] Inventor: Petrus W. Van Der Zon, Zwijndrecht, Netherlands

[73] Assignee: Thomas J. Lipton Co., Division of Conopco, Inc., Englewood Cliffs, N.J.

[21] Appl. No.: 131,262

[22] Filed: Oct. 1, 1993

[30] Foreign Application Priority Data

Oct. 2, 1992 [EP] European Pat. Off. ..... 92309014.6

[51] Int. Cl.[5] ..... B65D 81/34; B65B 29/04

[52] U.S. Cl. ..... 426/79; 426/80; 426/83; 206/0.5

[58] Field of Search ..... 426/77-84, 426/394; 206/0.5

[56] References Cited

U.S. PATENT DOCUMENTS

| | | | |
|---|---|---|---|
| 2,335,159 | 11/1943 | Salfisberg . | |
| 2,466,281 | 4/1949 | Shaw | 426/80 |
| 2,468,464 | 4/1949 | Salfisberg . | |
| 2,878,927 | 3/1959 | Haley . | |
| 2,881,910 | 4/1959 | Murphy | 426/80 |
| 2,986,269 | 5/1961 | Goldberg | 426/80 |
| 3,191,355 | 6/1965 | Morpurgo . | |
| 3,237,550 | 3/1966 | Christopher . | |
| 3,415,656 | 12/1968 | Lundgren . | |
| 3,597,222 | 8/1971 | Kalemba . | |

FOREIGN PATENT DOCUMENTS

| | | |
|---|---|---|
| WO91/13580 | 9/1991 | WIPO . |
| WO92/06903 | 4/1992 | . |

*Primary Examiner*—Steven Weinstein
*Attorney, Agent, or Firm*—James J. Farrell

[57] ABSTRACT

A dual compartment infusion packet has the compartments directly secured to each other at one end of the packet and separated by a V-fold of the packet material at the other end. A suspension thread has an intermediate portion lying within the fold and end portions extending therefrom through attachment means at the other end of the packet. The end portions are displaceable in the attachment means so that when tensioned they contract the packet to squeeze out liquid held in the packet after an infusion process.

7 Claims, 2 Drawing Sheets

INFUSION PACKETS

BACKGROUND OF THE INVENTION

This invention relates to packets in which a quantity of infusible or soluble material is held in a porous envelope which is immersed in liquid to prepare an infusion.

Such packets have the disadvantage that a significant proportion of the infused liquid remains in the packet unless and until the user squeezes it out. This can be an inconvenient and unpleasant operation, and infusion packets have been proposed which are provided with threads that can be pulled to contract the packet and express the surplus liquid, so that the user does not have to touch the packet itself.

In U.S. Pat. Nos. 3,396,032, 3,237,550, 2,986,269 and 2,878,927, the thread is looped centrally around the packet (as a double loop in the case of U.S. Pat. No. 3,396,032). The ends of the loop are secured to one end of the packet, typically by stapling in a manner which allows them to be drawn through the staple to tighten the loop and so contract a bag to squeeze out the surplus liquid. At the opposite end of the bag the loop must be securely located centrally of the packet at all times and for this purpose some of the known packets require a further staple (U.S. Pat. Nos. 3,396,032 and 2,986,269), which is a disadvantage both in the manufacture of the packet and in its use when the free movement of thread may be impaired. Alternatively that opposite end of the packet may be notched (U.S. Pat. Nos. 3,237,550 and 2,878,927), but the difficulty arises that the notching weakens the end seal of the packet, which is particularly important because the tightening of the loop of thread will apply additional stress at this point and bring the risk that the bag will burst and its contents be spilt. Increasing the width of the seal to avoid that danger leads to a wasteful use of material and, moreover, the consequent increase of size of the packet will usually be a disadvantage from the consumer's point of view.

Other proposals (U.S. Pat. Nos. 2,881,910 and 2,466,281) pass the thread through apertures in the walls of the packet and so avoid the need for a notch, but they have the disadvantage that the infusible material may leak through the apertures, whether before or during use.

SUMMARY OF THE INVENTION

According to the present invention, there is provided an infusion packet comprising a pair of superimposed compartments joined at opposite ends, the join at least at one of said ends comprising a folded region lying between the compartments and projecting towards the other said end, a thread having end portions held by attachment means at or adjacent said other end, and an intermediate portion located in said folded region of the packet between the compartments, the thread being displaceable in said attachment means by applying tension to the end portions to contract the packet for expressing liquid from the packet after infusion.

In this way, it is possible to retain the thread in place on the packet without incurring an increased risk of spillage or leakage. The double compartment form of the packet itself provides a relatively compact container for the infusible material and the invention is capable of being employed in such a way that the ability to contract the packet is obtained without requiring any increase of size, nor any additional securing means.

The end portions of the thread may be held between the compartments at said other end of the packet. In one such arrangement the compartments are heat sealed to each other at said other end with the formation of at least one space in the heat sealing providing passage means in which the thread end portions are displaceably held.

In an alternative arrangement, the respective end portions of the thread run exteriorly from said folded region to said other end of the compartments on opposite sides of the packet. It may then be convenient to hold said end portions of the thread by staple means at said other end of the packet.

Preferably, at least one of the end portions of the thread is attached to a tag. In one form of the invention, both end portions are attached to respectively separable parts of the tag so that the loop can be tightened by grasping the separated tab parts.

By way of example, the invention will now be described with reference to the accompanying drawings.

DESCRIPTION OF THE PREFERRED EMBODIMENTS

Figure 1:
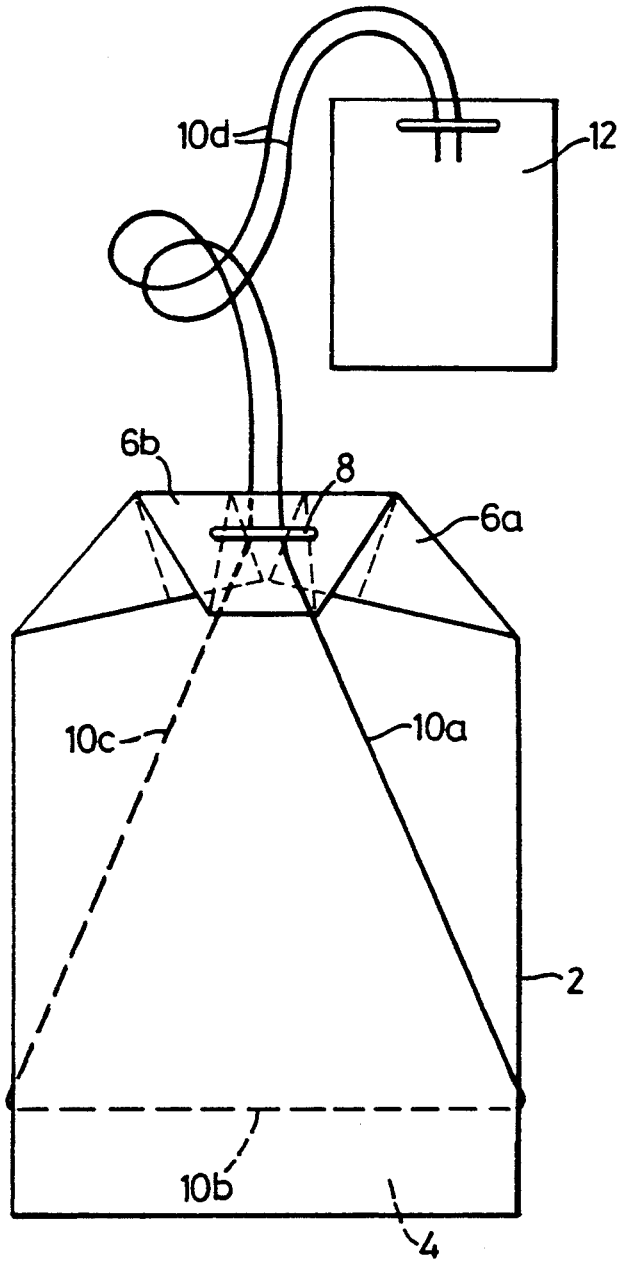
FIGS. 1 and 2 show a tea bag according to the invention in front and side views respectively.

The illustrated tea bag 2 comprises a tubular web of paper or the like permeable sheet material which has been formed into two superimposed compartments 2*a*, 2*b* each containing a dose of tea leaves. It is of course possible to utilise other infusible materials, such as ground coffee, in the same way. An intermediate portion of the tubular web which extends between the lower ends of the compartments 2*a*, 2*b* is formed in a V-fold 4 projecting towards the opposite end of the tea bag. At the upper end of the compartments, lateral and central flaps 6*a*, 6*b* of the web material are folded over and secured by a staple 8, preferably of aluminium, to seal in the contents of the compartments. In this example, the compartment 2*b* is shorter than the compartment 2*a* before the flaps are folded over, the flap 6*b* being formed by the top of the compartment 2*a* only.

A thread 10 captured by the staple 8 serves to suspend the packet in an infusing liquid. The thread passes around the tea bag, from the staple 8 in a first run 10*a* diagonally down one outer side of the bag and then at 10*b* along the V-fold to continue in a run 10*c* diagonally along the opposite outer side of the bag to the staple. The end portions of the thread are thus held captive under the staple 8 on opposite sides of the bag. The end portions are held sufficiently securely to avoid the risk that the intermediate portion 10*b* of the thread will slip out from the V-fold 4, but when tensioned the thread will slide easily through the staple 8 to tighten the loop passing through the V-fold. As a result, the tea bag is contracted and surplus liquid is expressed from its contents after the tea leaves have been infused.

The free ends 10*d* of the thread are shown stapled in a conventional manner to a tag 12 and they are gripped between the bag and the tag to squeeze the liquid from the bag. In a modification shown in FIGS. 4 and 5, a tag 12' is separable into two parts, by a weakening such as a line of perforations 22, and the free ends of thread are secured each to a respective one of said tag parts by glue or heat seals. When separated, the two parts of the tag provide convenient finger grips for pulling the thread and contracting the tea bag.

Before use, the free lengths of thread can be wound loosely round the bag or gathered into a coil or roll, preferably under the tag, and the tag can be temporarily tacked to the web to hold the thread in place.

Figure 2:
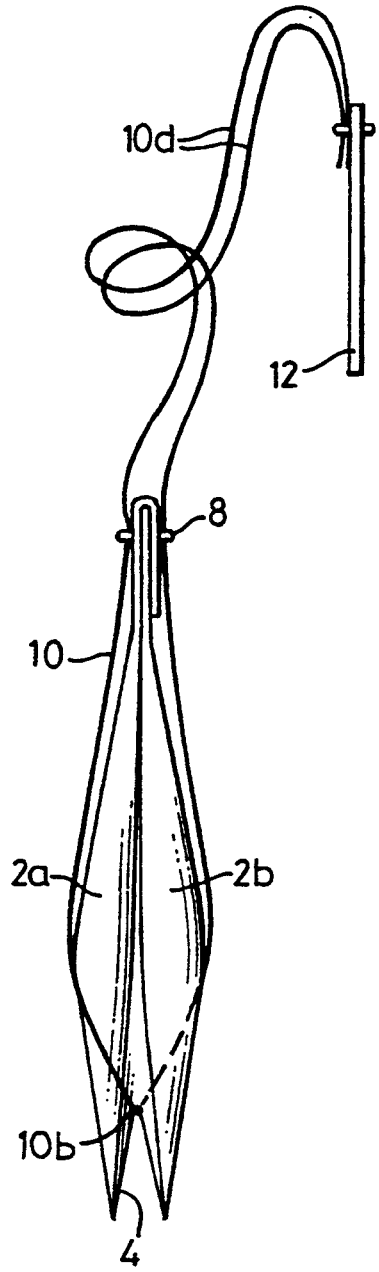
Figure 3:
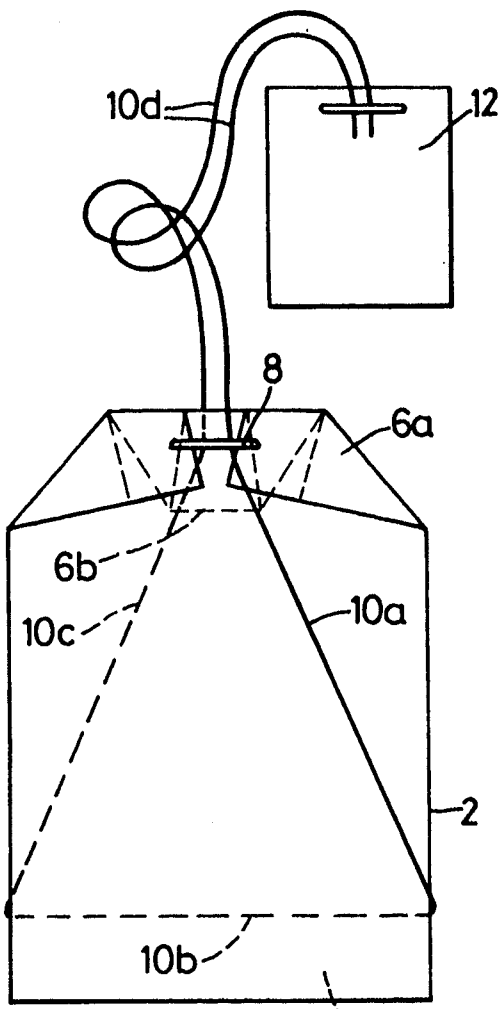

The closure flaps 6*a*, 6*b* can be folded over opposite sides of the tag bag instead of the same side as shown in FIGS. 1 and 2. In particular, FIG. 3 illustrates how the two lateral flaps 6*a* can be folded to one side, over one compartment, and the central flap 6*b* folded to the opposite side, over the other compartment.

Figure 5:
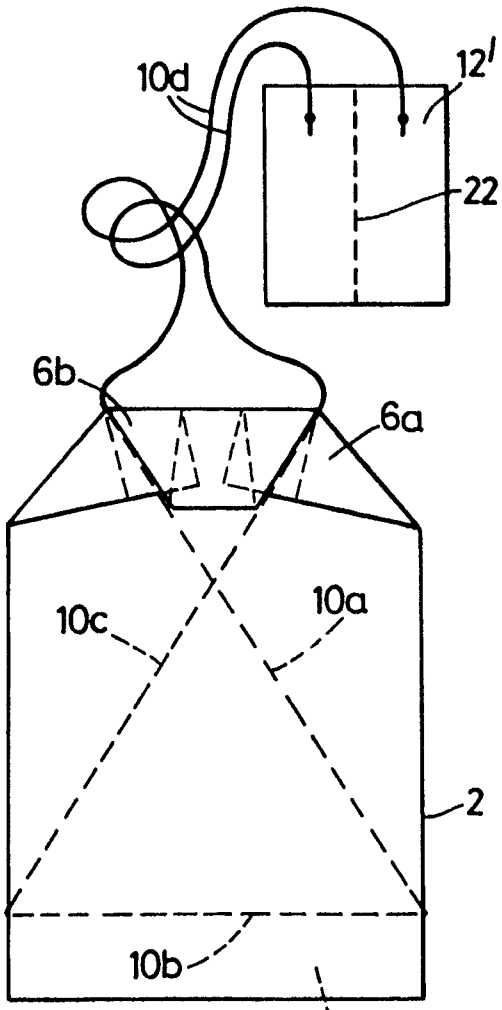
FIGS. 3 to 5 illustrate some modifications of the tea bag in FIGS. 1 and 2.
Figure 4:
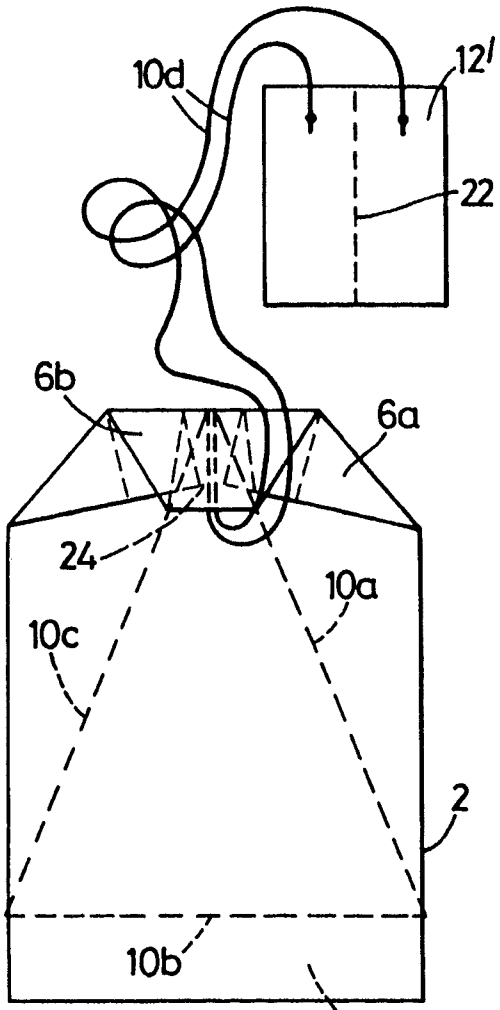

In another modification illustrated in FIG. 4, the end portions of the thread run, from the V-fold, between the opposed faces of the two compartments to the upper end of the tea bag. In this case, if the two compartments are secured together at that end of the bag by heat sealing the thread end portions can conveniently be located within the extent of the seal. For easy movement of the thread, such a heat seal could be interrupted across the width of the bag to form one or more channels through which the thread end portions extend, from the space between the compartments to the exterior. In the example of FIG. 4, the end thread runs 10*a*, 10*c* converge to pass through a common central passage 24 in the heat sealed top margin of the bag, underneath the flap 6*b*. The thread runs 10*a*, 10*c* may alternatively cross over each other in their course between the compartments, as is shown in FIG. 5, to be held by the flaps themselves and emerge from spaced regions at the upper end of the tea bags.

I claim:

1. An infusion packet having a first end and an opposite, second end and a pair of opposing side edges, said packet comprising a pair of superimposed compartments, each of said compartments containing a quantity of infusible or soluble material and extending to opposite ends of the packet and means joining the compartments together at each of said ends, said joining means at said first end comprising an inverted folded region of said packet, said folded region lying between the compartments at said first end and extending across the packet transverse to said ends, said inverted folded region forming a concavity at said first end of said pocket and said concavity projecting towards the opposite, second end, each of said opposing side edges of said packet Comprising both the adjacent side edges of said compartments and the adjacent respective side edges of said folded region, the packet further comprising a thread having an intermediate portion and two end portions extending therefrom, said thread intermediate portion being located in the concavity of the folded region of the packet between the compartments and extending across the packet from said adjacent side edges of said folded region to the opposite adjacent side edges of the folded region, the thread on each side of said intermediate portion extending along the compartments to said opposite second end to form a loop in said folded region, and attachment means in the region of said opposite second end of the packet holding the two thread end portions, the thread being held by said attachment means sufficiently securely to prevent the intermediate portion from slipping out from said folded region, yet the thread being displaceable in said attachment means by applying tension to the end portions such that the thread will slide easily through the attachment means to tighten the thread in the folded region and contract the packet.

2. An infusion packet according to claim 1 wherein said attachment means holding the end portions of the thread at said opposite second end of the packet also join the compartments together at said opposite second end.

3. An infusion packet according to claim 1 wherein the end portions of the thread are held at said opposite second end by staple means.

4. An infusion packet according to claim 1 wherein the end portions of the thread are held in passage means provided between said compartments for holding the end portions of the thread between the joined compartments at said opposite second end of the packet.

5. An infusion packet according to claim 1 wherein the thread runs between the compartments to said opposite second end of the packet.

6. An infusion packet according to claim 1 wherein said end portions converge towards each other from said folded region.

7. An infusion packet according to claim 1 wherein the respective thread end portions are secured to separable parts of a tag.

* * * * *